US006276782B1

(12) United States Patent
Sharma et al.

(10) Patent No.: US 6,276,782 B1
(45) Date of Patent: Aug. 21, 2001

(54) ASSISTED DROP-ON-DEMAND INKJET PRINTER

(75) Inventors: Ravi Sharma, Fairport; John A. Lebens, Rush, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/481,303

(22) Filed: Jan. 11, 2000

(51) Int. Cl.[7] ..... B41J 2/05
(52) U.S. Cl. ..... 347/56; 347/65; 347/67
(58) Field of Search ..... 347/54, 55, 56, 347/65, 48, 67

(56) References Cited

U.S. PATENT DOCUMENTS

| | | | | |
|---|---|---|---|---|
| 4,646,106 | | 2/1987 | Howkins | 347/9 |
| 5,726,693 | * | 3/1998 | Sharma et al. | 347/54 |
| 5,739,832 | | 4/1998 | Heinzl et al. | 347/68 |
| 5,825,385 | * | 10/1998 | Silverbrook | 347/56 |

* cited by examiner

*Primary Examiner*—Huan Tran
*Assistant Examiner*—Juanita Stephens
(74) *Attorney, Agent, or Firm*—Walter S. Stevens

(57) ABSTRACT

A droplet generator is provided that is particularly adapted for generating micro droplets of ink on demand in an inkjet printhead having a plurality of nozzles. The droplet generator includes a droplet separator formed from the combination of a droplet assistor and a droplet initiator. The droplet assistor is coupled to ink in each of the nozzles and functions to lower the amount of energy necessary for an ink droplet to form and separate from an ink meniscus extending across the nozzle outlet. The droplet assistor may be, for example, a heater or surfactant supply mechanism for lowering the surface tension of the ink meniscus. Alternatively, the droplet assistor may be a mechanical oscillator such as a piezoelectric transducer that generates oscillations in the ink sufficient to periodically form convex ink menisci across the nozzle outlets, but insufficient to cause ink droplets to separate from the outlets. The droplet initiator cooperates with the droplet assistor and selectively causes an ink droplet to form and separate from the ink meniscus. The droplet initiator may be, for example, a thermally-actuated paddle. The droplet separator increases the speed and accuracy of ink micro droplets expelled from the printhead nozzles.

20 Claims, 4 Drawing Sheets

ASSISTED DROP-ON-DEMAND INKJET PRINTER

FIELD OF THE INVENTION

This invention generally relates to a drop-on-demand inkjet printer having a droplet separator that includes a mechanism for assisting the selective generation of micro droplets of ink.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; DOT matrix impact printers; thermal paper printers; film recorders; thermal wax printers; dye diffusion thermal transfer printers; and inkjet printers. However, at present, such electronic printing systems have not significantly replaced mechanical presses, even though this conventional method requires very expensive set-up and is seldom commercially viable unless a few thousand copies of a particular page are to be printed. Thus, there is a need for improved digitally-controlled printing systems that are able to produce high-quality color images at a high speed and low cost using standard paper.

Inkjet printing is a prominent contender in the digitally controlled electronic printing arena because, e.g., of its non-impact, low-noise characteristics, its use of plain paper, and its avoidance of toner transfers and fixing. Inkjet printing mechanisms can be categorized as either continuous inkjet or drop-on-demand inkjet. Continuous inkjet printing dates back to at least 1929. See U.S. Pat. No. 1,941,001 to Hansell.

Drop-on-demand inkjet printers selectively eject droplets of ink toward a printing media to create an image. Such printers typically include a printhead having an array of nozzles, each of which is supplied with ink. Each of the nozzles communicates with a chamber which can be pressurized in response to an electrical impulse to induce the generation of an ink droplet from the outlet of the nozzle. Many such printers use piezoelectric transducers to create the momentary pressure necessary to generate an ink droplet. Examples of such printers are present in U.S. Pat. Nos. 4,646,106 and 5,739,832.

While such piezoelectric transducers are capable of generating the momentary pressures necessary for useful drop-on-demand printing, they are relatively difficult and expensive to manufacture since the piezoelectric crystals (which are formed from a brittle, ceramic material) must be micromachined and precision installed behind the very small ink chambers connected to each of the inkjet nozzles of the printer. Additionally, piezoelectric transducers require relatively high voltage, high power electrical pulses to effectively drive them in such printers.

To overcome these shortcomings, drop-on-demand printers utilizing thermally-actuated paddles were developed. Each paddle includes two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave which effectively ejects a droplet of ink out of the nozzle outlet.

Unfortunately, while such thermal paddle transducers overcome the major disadvantages associated with piezoelectric transducers in that they are easier to manufacture and require less electrical power, they do not have the longevity of piezoelectric transducers. Additionally, they do not produce as powerful and sharp a mechanical pulse in the ink, which leads to a lower droplet speed and less accuracy in striking the image media in a desired location. Finally, thermally-actuated paddles work poorly with relatively viscous ink mediums due to their aforementioned lower power characteristics.

Clearly, what is needed is an improved drop-on-demand type printer which utilizes thermally-actuated paddles, but which is capable of ejecting ink droplets at higher speeds and with greater power to enhance printing accuracy, and to render the printer compatible with inks of greater viscosity.

SUMMARY OF THE INVENTION

The invention solves all of the aforementioned problems by the provision of a droplet separator that is formed from the combination of a droplet assistor and a droplet initiator. The droplet assistor is coupled to ink in the nozzle and functions to lower the amount of energy necessary for an ink droplet to form and separate from an ink meniscus that extends across a nozzle outlet. The droplet initiator cooperates with the droplet assistor and selectively causes an ink droplet to form and separate from the ink meniscus.

Examples of the droplet assistor include mechanical oscillators coupled to the ink in the nozzle for generating oscillations in the ink sufficient to periodically form a convex ink meniscus across the nozzle, but insufficient to cause ink droplets to separate from the nozzle. In the preferred embodiments, such a mechanical oscillator may be a piezoelectric transducer coupled onto the back substrate of the printhead. The droplet assistor may also include devices that lower the surface tension of the ink forming the meniscus in the nozzle. In the preferred embodiments, such devices include heaters disposed around the nozzle outlet for applying a heat pulse to ink in the nozzle, and surfactant suppliers for supplying a surfactant to ink forming the meniscus. Examples of surfactant suppliers used as a droplet assistor would be a mechanism for injecting a micro slug of surfactant into the nozzle when the formation of an ink droplet is desired, and a surfactant distributor continuously applying a thin surfactant film over the outer surface of the printhead so that surfactant is always in contact with ink in the menisci of the printhead nozzles.

When the droplet assistor is a mechanical oscillator, the droplet initiator may be a thermally-actuated paddle. In addition to the mechanical oscillator, the droplet assistor may also include a heater disposed near the nozzle outlet for applying a heat pulse to heat in the nozzle to lower surface tension therein at a selected time, or a surfactant supplier that lowers surface tension in ink forming the meniscus.

Various other combinations of the aforementioned mechanical oscillators and surface tension reducing devices may also be used to form a droplet separator of the invention. In all cases, the use of a cooperating combination of paddle transducers, mechanical oscillators and/or surface tension reducing devices advantageously increases the speed and accuracy of the separating droplets, increases the longevity of the printer, and renders the printer easier and less expensive to manufacture than prior art printers which exclusively utilize a separate, precision-made piezoelectric transducer in each of the nozzles of the printer.

DETAILED DESCRIPTION OF THE INVENTION

Figure 1:
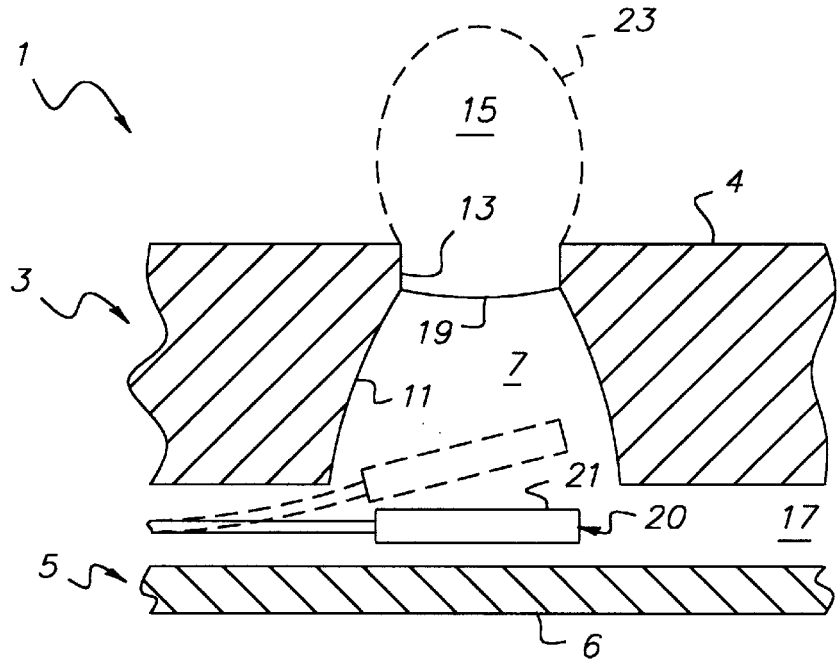
FIG. 1 (PRIOR ART)
FIG. 1 is a cross-sectional side view of a nozzle in a conventional drop-on-demand printhead that utilizes a thermally-actuated paddle in each nozzle to generate and eject ink droplets.

With reference now to FIG. 1, wherein like components are designated by like reference numerals throughout all of the several figures, a prior art printhead I generally comprises a front substrate 3 having an outer surface 4 and a back substrate 5 having a rear surface 6. A plurality of nozzles 7 are disposed between the substrates 3,5, only one of which is shown. Each nozzle has lower, tapered side walls 11, and upper cylindrical side walls 13. The upper side walls 13 define a circular nozzle outlet 15. An ink conducting channel 17 is provided between the substrates 3,5 for providing a supply of liquid ink to the interior of the nozzle 7. The liquid ink forms a concave meniscus 19 around the upper side walls 13 that define the nozzle outlet 15. In the prior art, each nozzle 7 is provided with a droplet separator 20, which is illustrated as consisting of a thermally-actuated paddle 21 in FIG. 1. In operation, an electric pulse is applied to the stem of the paddle 21. The pulse in turn generates a heat pulse which momentarily heats up the stem of the paddle 21. As the paddle stem is formed from two materials having different coefficients of expansion, it momentarily curls into the position illustrated in phantom in response to the heat pulse. The shockwave that the curling motion of the paddle 21 transmits to the liquid ink inside the nozzle 7 results in the formation and ejection of a micro droplet 23 of ink (shown in phantom) from the printhead 1. Unfortunately, such thermally actuated paddles 21 generally do not eject such micro droplets 23 with sufficient speed and accuracy toward the printing medium (not shown).

Figure 2:
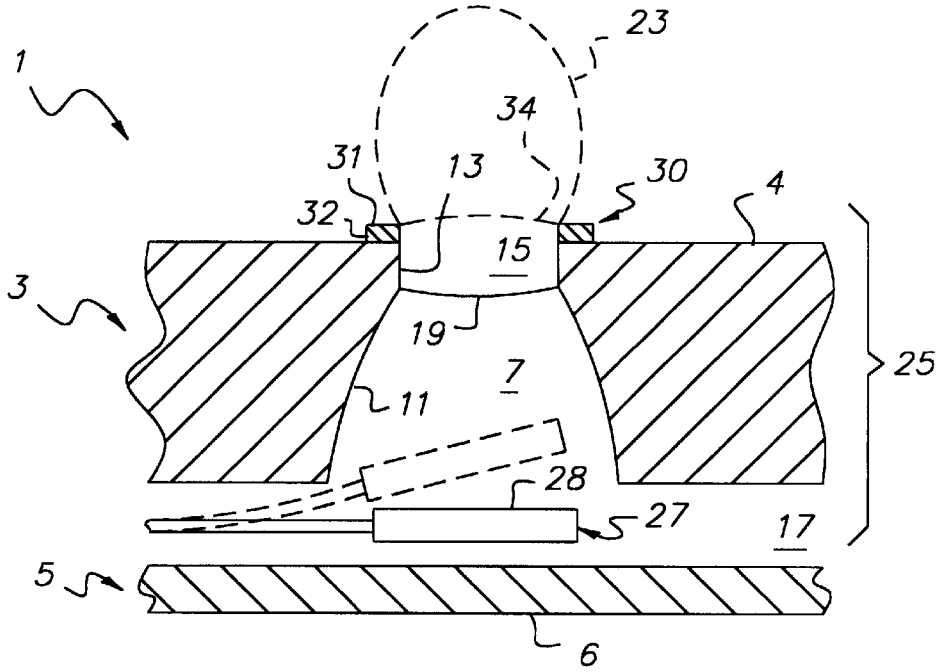
FIG. 2 is a cross-sectional side view of a printhead nozzle incorporating the droplet separator of the invention, which includes the combination of a thermally-actuated paddle to create an oscillating meniscus in the nozzle outlet and an annular heater disposed around the nozzle outlet.

The invention is an improvement over the droplet separator 20 illustrated in FIG. 1. With reference now to FIG. 2, the droplet separator of the invention 25 includes the combination of a droplet initiator 27 and a droplet assistor 30. In this embodiment, the droplet initiator 27 is a thermally-actuated paddle 28 of the same type described with respect to FIG. 1. The droplet assistor 30 is a heater 31 having an annular heating element 32 that closely circumscribes the nozzle outlet 15. Such a heater may easily be integrated onto the top surface 4 of the printhead by way of CMOS technology. When an electrical pulse is conducted through the annular heating element 32, the heater 31 generates a momentary heat pulse which in turn reduces the surface tension of the ink in the vicinity of the meniscus 19. Such heaters and the circuitry necessary to drive them are disclosed in U.S. patent application Ser. No. 08/954,317 filed Oct. 17, 1997 and assigned to the Eastman Kodak Company, the entire text of which is incorporated herein by reference.

In operation, micro droplets of ink are generated by simultaneously conducting an electrical pulse to both the thermally-actuated paddle 28 and the heater 31. Hence, the paddle 28 immediately curls into the position indicated in phantom while the heat pulse generated by the annular heating element 32 lowers the surface tension of the ink in the meniscus 19, and hence the amount of energy necessary to generate and expel an ink droplet 23 from the nozzle outlet 15. The end result is that an ink droplet 23 is expelled at a high velocity from the nozzle outlet 15 which in turn causes it to strike its intended position on a printing medium with greater accuracy. Additionally, the mechanical stress experienced by the thermally-actuated paddle 28 during the ink droplet generation and expulsion operation is less than it otherwise would be if there were no heater 31 for assisting in the generation of ink droplets. Consequently, the mechanical longevity of the thermally-actuated paddle 28 is lengthened.

Figure 3:
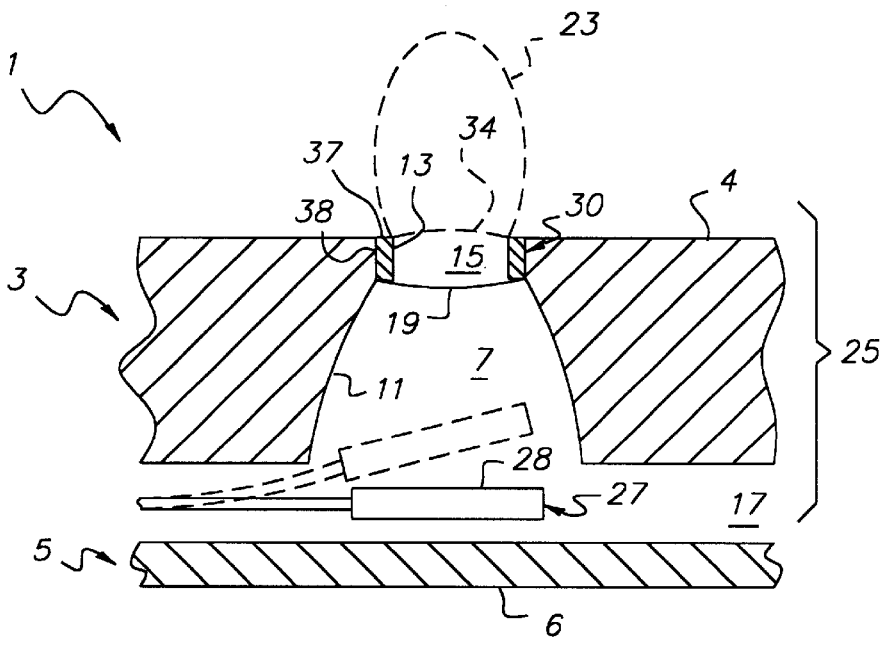
FIG. 3 is a variation of the embodiment of the invention illustrated in FIG. 2, wherein the annular heater is disposed around the side walls of the nozzle outlet rather than on the upper surface of the nozzle plate.

FIG. 3 illustrates a variation of the embodiment of the invention illustrated in FIG. 2, wherein the heater 37 includes an annular heating element 38 which circumscribes the upper cylindrical side walls 13 of the nozzle 7. While such a variation of the invention is slightly more difficult to manufacture, it has the advantage of more effectively transferring the heat pulse generated by the heating element 38 to the ink forming the meniscus 19. In all other respects, the operation of the variation of the invention in FIG. 3 is the same as that described with respect to FIG. 2.

Figure 4A:
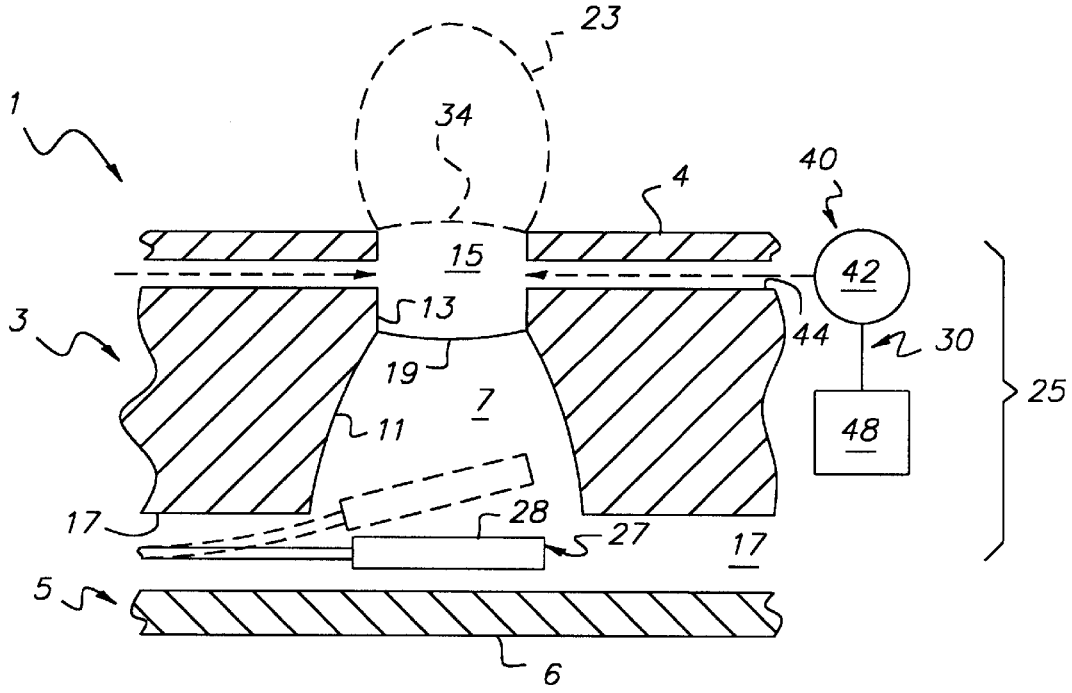
FIG. 4A is a cross-sectional side view of a printhead nozzle incorporating an alternative embodiment of the droplet separator of the invention formed from the combination of a thermally-actuated paddle and a surfactant injector.
Figure 4B:
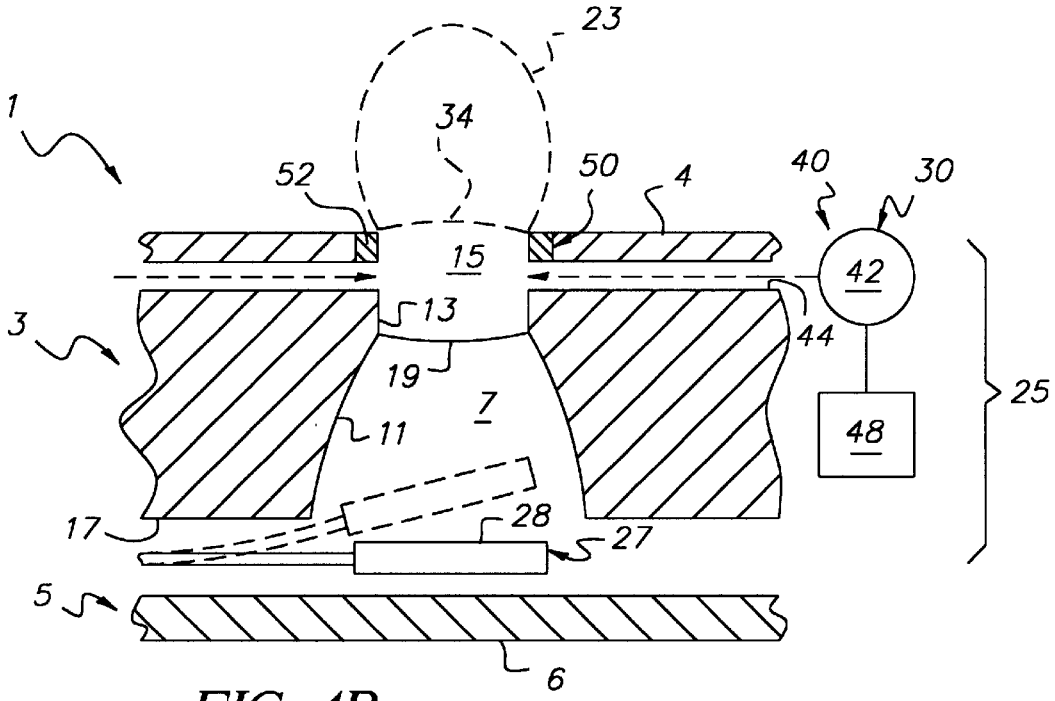
FIG. 4B is a variation of the embodiment of the invention illustrated in FIG. 4A, wherein the annular heater is disposed around the side walls of the nozzle outlet.

FIGS. 4A and 4B illustrates still another embodiment of the invention. Here, the droplet assistor 30 of the droplet separator 25 is a surfactant supplier 40 that operates to lower the surface tension of ink in the meniscus 19 via a liquid surfactant, instead of with a heat pulse as previously described. The surfactant supplier 40 includes a surfactant injector 42 (which may be a micro pump capable of generating micro slugs of a liquid surfactant upon demand) whose output is connected to a bore 44 that leads into the upper cylindrical side walls 13 of nozzle 7. The surfactant injector 42 is in turn connected to a surfactant supply reservoir 48. The operation of this embodiment of the invention is similar to the one described with respect to FIG. 2, in that electrical actuation pulses are simultaneously conducted to the thermally-actuated paddle 28 into the surfactant injector 42 at the time the formation of an ink droplet is desired. The paddle 28 curls into the position illustrated in phantom while the surfactant injector 42 delivers a small slug of liquid surfactant to the ink forming the meniscus 19 through the bore 44. Because the surfactant lowers the surface tension of the ink in the meniscus 19, the energy necessary to form and eject an ink droplet is lessened at the time that the thermally-actuated paddle 28 is actuated. The resulting ink droplet 23 is accordingly expelled at a higher velocity, which in turn results in a more accurate printing operation.

FIG. 4B illustrates a variation of the embodiment illustrated in FIG. 4A, the difference being the addition of a heater 50 as part of the droplet assistor 30. In this variation, an electrical pulse is conducted to the annular heating element 52 of heater 50 at the same time such pulses are conducted to the surfactant injector 42 and the thermally-actuated paddle 28. The resulting heat pulse generated by the heater 50 assists the surfactant injector 42 in lowering the surface tension of the ink forming the meniscus 19. Since the combination of the surfactant injector 42 and heater 50 lowers the surface tension of the ink in the meniscus 19 even more than the use of just the surfactant ejector 42 alone, this variation of the invention is capable of generating and ejecting a droplet of ink 23 at an even higher velocity than droplets ejected from the embodiment of FIG. 4A.

Figure 5:
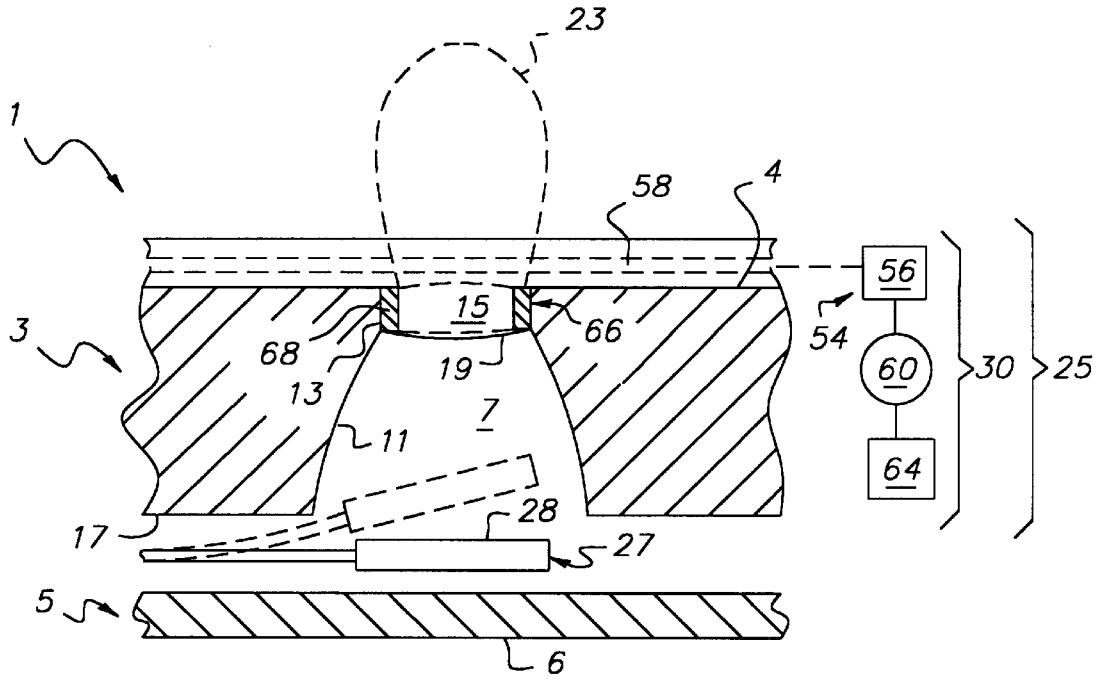
FIG. 5 is a cross-sectional side view of a printhead nozzle incorporating still another embodiment of the invention, wherein the droplet separator is formed from the combination of a thermally-actuated paddle and a surfactant supplier that continuously distributes a thin film of surfactant over the outer surface of the printhead.

FIG. 5 illustrates still another embodiment of the invention. Here, the droplet assistor 30 is a surfactant supplier 54 that operates via a surfactant film distributor 56 rather than a surfactant injector 42 as described with respect to the embodiment of FIGS. 4A and 4B. The surfactant film distributor 56 may be any mechanism capable of maintaining a liquid (or even solid but fusible) film of surfactant over the outer surface 4 of the printhead 1 to create a surfactant film 58. The fill distributor 56 is connected to a pump 60 which in turn communicates with a surfactant supply reservoir 64. Possible structures for the film distributor 56 include a manifold of micro pipes or a structure of corrugated walls disposed over the outer surface 4 for continuous distributing small slugs of liquid surfactant over the surface 4. Structures capable of applying and maintaining a thin liquid film of surfactant over the surface 4 are known in the prior art, and do not, per se, constitute any part of the instant invention.

In contrast to the operation of the embodiment described with respect to FIGS. 4A and 4B, there is no need to simultaneously conduct a pulse of electricity to the film type surfactant supplier 54 at the time the generation of a droplet of ink is desired. Instead, all that is necessary is to actuate the paddle 28 by conducting an electrical pulse thereto so that is curls into the position illustrated in phantom. Because of the continuous contact between the surfactant film 58 and the ink meniscus 15, the energy necessary to generate and expel an ink droplet 23 is substantially lowered. The end result is that the thermally-actuated paddle 28 creates a higher velocity ink droplet than it otherwise would without the assistance of the film-type surfactant supplier 54 and with less mechanical stress to itself.

Optionally, a heater 66 may be added to this embodiment of the invention. Preferably, such a heater 66 includes an annular heating element 68 disposed around the upper, cylindrical side walls 13 of the nozzle 7. Such a heater location is preferred, as locating the heating element on top of the surface 4 could interfere with the flow of surfactant into the meniscus 19. In this variation of the invention, electrical pulses are simultaneously conducted to both the annular heating element 68 and the thermally-actuated paddle 28 to create and expel an ink droplet 23. As was the case with the embodiment of the invention illustrated in FIG. 4B, the combination of the surfactant supplier 54 and heater 66 results in a higher velocity ink droplet 23 than if the surfactant supplier 54 were the only component of the droplet assistor 30.

Figure 6A:
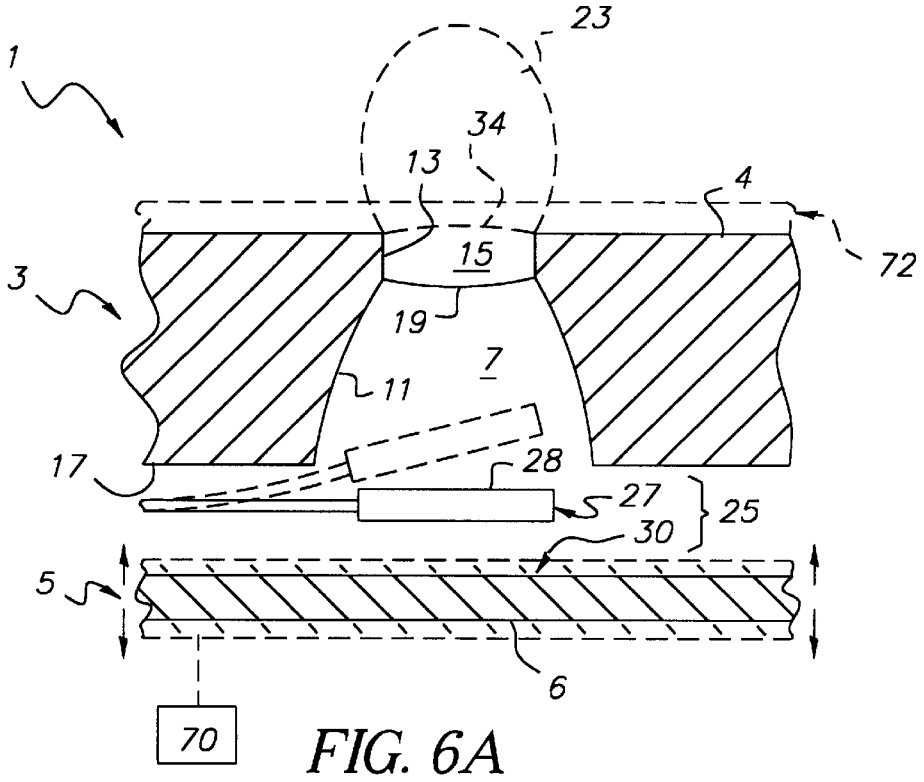
FIG. 6A illustrates still another embodiment of the droplet separator of the invention installed within the printhead nozzle, which is formed from the combination of a thermally-actuated paddle and a piezoelectric transducer coupled to the rear substrate of the printhead.

With reference now to FIG. 6A, the droplet separator 25 of the invention may include a droplet assistor 30 formed from a piezoelectric transducer 70 that is mechanically coupled to the rear surface 6 of the back substrate 5 of the printhead 1. A series of relatively high frequency electrical pulses is conducted to the piezoelectric transducer 70 so that the ink meniscus periodically flexes from the concave position 19 to a convex position 34. It should be noted that the power of the electrical pulses conducted to the transducer 70 is selected so that the resulting oscillatory energy is sufficient to periodically create a convex meniscus 34 in the ink, but insufficient to cause the generation and separation of the ink droplet. When the generation of an ink droplet is desired, an electrical pulse is conducted to the thermally-actuated paddle 28 at the same time the piezoelectric transducer 70 creates a convex meniscus 34 in the ink. An ink droplet 23 is consequently generated and expelled at a higher velocity than it would be if the paddle 28 alone were used due to the additional kinetic energy added to the ink by the piezoelectric transducer 70. Timing circuits capable of conducting electrical pulses to the paddle 28 when the transducer 70 creates the aforementioned convex meniscus 34 are known in the prior art, and per se form no part of the instant invention. As is indicated in phantom, a film distributor-type surfactant supplier 72 may be added to the embodiment of the invention illustrated in FIG. 6A in order to create an even greater increase in the velocity of the ejected ink droplet 23.

Figure 6B:
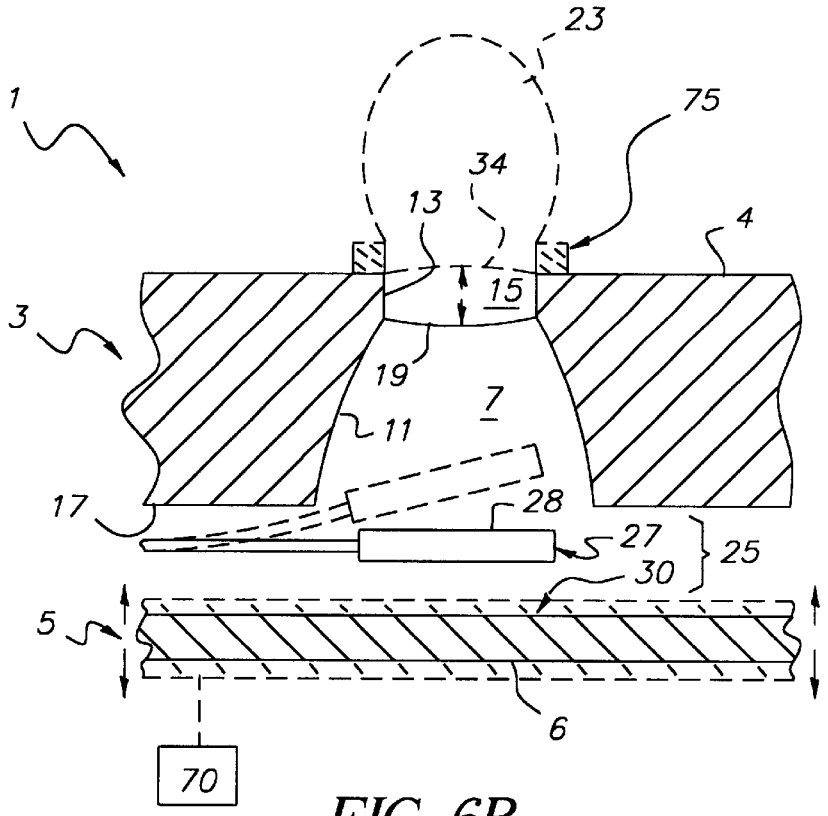
FIG. 6B is a variation of the embodiment illustrated in FIG. 6A wherein an optional nozzle heater is added in lieu of an optional surfactant supplier.

The embodiment of the invention illustrated in FIG. 6B is essentially the same as that illustrated in FIG. 6A, the sole difference being that a heater 75 (shown in phantom) may optionally be added around the nozzle outlet 15. Like the addition of the film-type surfactant supplier 54 to the embodiment of FIG. 6A, the addition of heater 75 to the embodiment illustrated in FIG. 6B creates a higher velocity ink droplet 23 than would otherwise be generated if the sole component of the droplet assistor 30 were the piezoelectric transducer 70 alone.

While the mechanical oscillator of the invention has been described in terms of a piezoelectric transducer, any type of electromechanical transducer could be used to implement the invention. Additionally, the invention encompasses any operable combination of the aforementioned droplet assistors and initiators, and is not confined to the combination used in the preferred embodiments, which are exemplary only.

PARTS LIST

1. Printhead
3. Front substrate
4. Outer surface
5. Back substrate
6. Rear surface
7. Nozzle
11. Lower, tapered side walls
13. Upper, cylindrical side walls
15. Nozzle outlet
17. Ink conducting channel
19. Ink meniscus (concave)
20. Droplet separator (prior art)
21. Thermally-actuated paddle
23. Droplet
25. Droplet separator of invention
27. Droplet initiator
28. Thermally-conducted paddle
30. Droplet assistor
31. Heater
32. Annular heating element
34. Convex ink meniscus
37. Heater
38. Annular heating element

40. Surfactant supplier
42. Surfactant injector
44. Bore
48. Surfactant supply
50. Heater
52. Annular heating element
54. Surfactant supplier
56. Film distributor
58. Film
60. Pump
64. Surfactant supply
66. Heater
68. Annular heating element
70. Piezoelectric transducer
72. Optional surfactant film distributor
75. Optional heater

What is claimed:

1. A droplet generator particularly adapted for generating droplets for a drop-on-demand inkjet printer, comprising:

an inkjet printhead having a nozzle with an outlet, and an ink supply channel for conducting liquid ink to said nozzle; and a droplet separator including:

a droplet assistor coupled to ink in said nozzle for lowering an amount of energy necessary for an ink droplet to form and separate from ink at said outlet, and a droplet initiator cooperating with said droplet assistor for selectively causing an ink droplet to form and separate from said outlet at high-speed wherein said droplet initiator includes a thermally-actuated paddle.

2. The droplet generator defined in claim 1, wherein said droplet assistor includes a heater disposed near said nozzle outlet for applying a heat pulse to ink in said nozzle to lower surface tension in said ink meniscus.

3. The droplet generator defined in claim 2, wherein said heater includes a heating element that substantially surrounds said nozzle outlet.

4. The droplet generator defined in claim 3, wherein said nozzle outlet terminates in an outer surface of said printhead and said heating element circumscribes said outlet on said outer surface.

5. The droplet generator defined in claim 3, wherein said nozzle includes side walls that terminate in said outlet, and said heating element circumscribes said side walls.

6. The droplet generator defined in claim 2, wherein said droplet assistor includes a surfactant supplier for supplying surfactant to ink in said nozzle.

7. The droplet generator defined in claim 6, wherein said surfactant supplier includes a surfactant injector in communication with an interior of said nozzle for injecting surfactant into said nozzle at a time when the formation and separation of an ink droplet is desired.

8. The droplet generator defined in claim 6, wherein said surfactant supplier is a means for maintaining a film of surfactant over said nozzle outlet such that an ink meniscus is continuously in contact with said surfactant.

9. The droplet generator defined in claim 2, wherein said droplet assistor also includes a heater disposed near said nozzle outlet for applying a heat pulse to ink in said nozzle to lower surface tension in an ink meniscus at said outlet.

10. The droplet generator defined in claim 8, wherein said droplet assistor also includes a heater disposed near said nozzle outlet for applying a heat pulse to ink in said nozzle to lower surface tension in said ink meniscus.

11. The droplet generator defined in claim 1, wherein there are a plurality of said nozzle and the ink supply channel conducts liquid ink to the plurality of nozzles and said droplet assistor includes a piezoelectric transducer located behind the plurality of nozzles for generating oscillations in said ink sufficient to periodically form a convex ink meniscus across the nozzle outlets but insufficient to cause an ink droplet to form and separate from said nozzles except for a nozzle having a paddle that is actuated to initiate a droplet.

12. The droplet generator defined in claim 11, wherein said droplet assistor further includes a surfactant supplier for supplying surfactant to ink in the nozzle.

13. The droplet generator defined in claim 11, wherein said droplet assistor further includes a heater disposed near said nozzle outlet for applying a heat pulse to ink in said nozzle to lower surface tension in said ink meniscus.

14. A method for generating droplets of ink from the nozzle of an inkjet printhead on a drop-on-demand basis, comprising the steps of:

lowering an amount of energy necessary for an ink droplet to form and separate from an outlet of said nozzle, and selectively inducing droplet formation and separation from said outlet at high-speed wherein said droplet formation is selectively induced by a thermally actuated paddle in said ink.

15. The method of claim 14, wherein said droplet formation energy is lowered by lowering surface tension of the ink across a meniscus of ink.

16. The method of claim 15, wherein the surface tension is lowered by conducting a heat pulse to ink forming the meniscus.

17. The method of claim 15, wherein the surface tension is lowered by supplying a surfactant to ink forming the convex meniscus.

18. The method of claim 15, wherein there are a plurality of the nozzles and said droplet formation energy is lowered by adding oscillatory energy to liquid ink in a channel connected to each of plural of the nozzles such that concave and convex menisci are periodically formed at each nozzle outlet but a droplet is selectively only created at a nozzle outlet when the paddle is thermally actuated.

19. The method of claim 18, wherein said additional oscillatory energy is induced in said ink channel by a piezoelectric transducer.

20. The method of claim 18, wherein a heater is disposed near said nozzle outlet for applying a heat pulse to ink in said nozzle to lower surface tension in an ink meniscus at the nozzle outlet.

* * * * *